US008766223B2

(12) United States Patent
Koch et al.

(10) Patent No.: US 8,766,223 B2
(45) Date of Patent: Jul. 1, 2014

(54) DEVICE FOR MONITORING ROLLS OF FILM MATERIAL WOUND THEREON AND PACKAGING MACHINE

(75) Inventors: Peter Koch, Seeon (DE); Fabian Huber, Grafing (DE)

(73) Assignee: Krones AG, Neutraubling (DE)

( * ) Notice: Subject to any disclaimer, the term of this patent is extended or adjusted under 35 U.S.C. 154(b) by 454 days.

(21) Appl. No.: 13/053,926

(22) Filed: Mar. 22, 2011

(65) Prior Publication Data

US 2011/0225930 A1 Sep. 22, 2011

(30) Foreign Application Priority Data

Mar. 22, 2010 (DE) ..... 10 2010 016 055 U

(51) Int. Cl.
*G01N 21/86* (2006.01)
*G01V 8/00* (2006.01)

(52) U.S. Cl.
USPC ..... 250/559.4; 53/389.4; 242/364.7

(58) Field of Classification Search
USPC ..... 250/559.29, 559.4, 559.39; 242/364.7, 242/485.4, 485.5, 487.5; 53/389.4; 347/16, 347/14, 106; 356/635, 429, 430, 431
See application file for complete search history.

(56) References Cited

U.S. PATENT DOCUMENTS

| | | | | |
|---|---|---|---|---|
| 4,913,366 | A | 4/1990 | Andou | |
| 5,177,446 | A | 1/1993 | Boriani et al. | |
| 5,607,121 | A | 3/1997 | Boriani et al. | |
| 5,769,353 | A | 6/1998 | Juhe et al. | |
| 6,059,222 | A | 5/2000 | Yuyama et al. | |
| 2008/0142631 | A1 | 6/2008 | Vorhees | |
| 2009/0212086 | A1 | 8/2009 | Ito | |
| 2012/0167739 | A1 * | 7/2012 | Lewis et al. | 83/663 |
| 2013/0099924 | A1 * | 4/2013 | Larsson et al. | 340/540 |

FOREIGN PATENT DOCUMENTS

| | | | |
|---|---|---|---|
| CN | 85101638 | | 1/1987 |
| DE | 40 21 402 | A1 | 1/1991 |
| DE | 44 42 154 | | 10/1995 |
| DE | 195 43 246 | | 5/1996 |
| DE | 198 47 466 | A1 | 4/2000 |
| DE | 10 2008 020 299 | A1 | 10/2009 |
| EP | 0 730 960 | A2 | 9/1996 |
| EP | 2 093 172 | A2 | 8/2009 |
| JP | 600 12 449 | A | 1/1985 |
| JP | 610 86 355 | A | 5/1986 |
| JP | 2004 2 49 536 | A | 9/2004 |
| JP | 2005 0 14 250 | A | 1/2005 |
| WO | 2009130071 | A1 | 10/2009 |

OTHER PUBLICATIONS

Brochure—"KRONES Variopac Pro" KRONES AG—May 2009.

* cited by examiner

*Primary Examiner* — Francis M Legasse, Jr.
(74) *Attorney, Agent, or Firm* — Simpson & Simpson, PLLC

(57) ABSTRACT

A packaging machine and a device for monitoring a roll with film material wound thereon is disclosed. By means of a sensor arrangement, an end of the film material on the roll may be detected. The sensor arrangement includes at least one optoelectric sensor arranged stationary relative to a front side of the roll. The optoelectric sensor is designed such that a portion of an outer circumference of the rotating roll may be detected.

13 Claims, 4 Drawing Sheets

DEVICE FOR MONITORING ROLLS OF FILM MATERIAL WOUND THEREON AND PACKAGING MACHINE

CROSS-REFERENCE TO RELATED APPLICATIONS

This Patent Application claims the benefit of German Patent Application No. 10 2010 016 055.5, filed on Mar. 22, 2010 which is hereby incorporated by reference.

FIELD OF THE INVENTION

The present invention relates to a device for monitoring rolls having film material wound thereon. The roll includes a core onto which the film material is wound.

The invention further relates to a packaging machine for generating packs of articles with a sensor arrangement to detect the end of film material on at least one roll of the packaging machine.

BACKGROUND OF THE INVENTION

As disclosed in German patent application DE 10 2008 020 299 A1, a packaging machine includes two rolls having film material wound thereon. One of the two rolls is always a stock roll providing film material for the packaging process for the articles to be packaged if the film material wound on the active roll runs out. For reasons of environmental protection and cost, it is necessary to use the film material on the active roll until it has been unwound as far as possible down to the core. The end of the film on the active roll must be indicated so that the second roll (spare roll) can be brought into the packaging process to thus provide the film material wound thereupon to the packaging process.

As may be seen in the corporate brochure of the company Krones AG regarding the fully automated "Vario Pack Pro" packaging machine, there is disclosed a packaging machine for a wide range of applications. The bottles entering the packaging machine are separated into groups. The films used for wrapping each group are pulled off an active roll. The groups are then wrapped with the film and subsequently pass through a shrink tunnel. The individually cut film portions are separated from the film material pulled off the roll by means of a cutting knife according to the length required for wrapping the objects. The second roll, which is also associated to the packaging machine, is introduced to the packaging process when the film wound upon the first roll is running out.

German published application DE 40 21 402 A1 describes a device for monitoring rolls being depleted. This device is mainly used in wrapping machines for articles. The corresponding monitoring device essentially consists of detection means operating in the area of a supply station of the belt at a wrapping station and/or near a group of roll and support shaft arranged in the area of the station. These detection means allow detecting a predetermined value of electrical impedance generated by the group of roll and/or support shaft and/or determining functions of at least one radial dimension of the group of roll and support shaft. For this purpose, the means rests on the roll and moves in the direction of the core and/or the axis of the roll as the thickness of the film material wound on the roll decreases to thus use the measured signals for concluding the amount of film material still wound on the roll.

German published application DE 195 43 246 discloses a device for controlling rolls for wrapping machines. The web material (film material) is wound on a roll for the wrapping machines. The roll has a corresponding core around which the film material is wound. The roll rotates around its own axis of rotation to thus provide the film material wound thereupon to the wrapping machine. An optoelectronic and light-sensitive sensor is associated with the roll and is movable along an essentially radial direction of the roll itself during the unwinding process of the roll. The sensor allows determining the value of a chromatic property of an area of the roll and sending a signal of a hue to the sampling device, which corresponds to a preset sample value. The film material wound directly around the core of the roll is colored so that the sensor will sense another color value of the film when approaching the end of the film material on the roll and will thus indicate the end of the film material on the respective active roll.

U.S. patent application 2008/0142631 A1 discloses a system and a method indicating the supply of paper in a printer. The paper is wound around a core of a roll. The core has a predetermined diameter. The paper wound around the core reduces the diameter when the paper is used by the printer. A scanning means is provided, which determines the core diameter and the paper diameter. A signal is output when the length of the paper material wound around the core under-runs a certain threshold.

European patent application EP 2 093 172 A2 describes a paper supply for a printer, wherein the paper supply is arranged on at least one roll. The paper supply includes at least two receptacles for the rolls that are arranged in different ways so that different sizes of paper rolls may be processed by the printer. An adjustable end sensor is provided for detecting the end of the paper wound upon a core. The adjustability allows adjusting the sensor to the respective position of the roll.

Japanese patent application JP 600 12 449 A describes a device for detecting the end of a film material wound on a roll. For this purpose, a magnetic strip is provided across the width of the film material near the end of the film material. When the film material is unwound from the roll, this magnetic strip is detected by means of a detector, which indicates the end of the film material on the roll.

Furthermore, Japanese patent application JP 61 08 63 55 A describes an arrangement that allows detecting a joint and/or end of long film-like material. The joint runs transversely across the film web and is detected by means of two photosensors. The photosensors are arranged in the direction of transport of the film material.

German published application DE 44 42 154 describes a method for initiating an early change of rolls. For this purpose, contactless temperature measurement is provided at the front side. Based on the measured temperature near the core of the roll, the amount of paper still on the roll or already wound onto the roll may be concluded.

European patent application EP 0 730 960 A2 describes a method and a device for determining the end of film material wound on a roll. For this purpose, at least two strips that are detected by a corresponding sensor means are provided transversely across the film material on the film material. In one embodiment, the sensor means consists of a light source and a correspondingly associated photodetector. The strips indicating the amount of film material still wound upon the core are detected by the sensor means.

German published application DE 198 47 466 A1 describes a method and a device for detecting defective regions in unwindable plastic webs. The sensor is attached to a lever arm moving in the direction of the core depending on the film material unwound from the roll. The sensor detects marking elements applied to the film material that project laterally from the front side of the film material.

BRIEF SUMMARY OF THE INVENTION

It is the object of the invention to provide a device detecting the end of a film material on a roll in a cost-efficient and reliable manner, independent of parameters of the film material wound on the roll.

This object is achieved by a device for monitoring a roll of film material wound thereon upon a core of the roll. The device comprises a sensor arrangement for detecting an end of the film material on the roll. At least one optoelectric sensor is part of the sensor arrangement. The optoelectric sensor is arranged stationary relative to a front side of the rotating roll resting on a mandrel, and is designed such that part of the front side of the rotating roll is optically detectable.

A further object is to provide a packaging machine by which a film material on a roll for packing or wrapping goods is used in a cost-efficient and reliable manner and the downtime of the packaging machine is minimized.

This object is achieved by a packaging machine for generating packs of articles. The packaging machine has a device for monitoring at least one roll of film material wound thereon upon a core of the roll. The device comprises a sensor arrangement for detecting an end of the film material on the roll. At least one optoelectric sensor is part of the sensor arrangement. The optoelectric sensor is arranged stationary relative to a front side of the rotating roll resting on a mandrel, and is designed such that part of the front side of the rotating roll is optically detectable.

The film material is wound upon a core of a roll. The end of the film material on the roll may be detected by means of a sensor arrangement. The sensor arrangement is designed such that it includes at least one optoelectronic sensor. The optoelectronic sensor is stationary relative to a front side of the roll. The sensor is designed such that part of the front side of the rotating roll is optically detectable.

Relative to the roll, the optoelectronic sensor is arranged such that the part of the outer circumference of the rotating roll detected by the optoelectronic sensor includes the core and the film material directly adjacent to the core.

According to a further embodiment, the optoelectronic sensor is arranged, relative to the roll, such that the part of the front side of the rotating roll that is detected by the optoelectronic sensor includes a potential air gap between the mandrel and the core, the core itself and the film material directly adjacent to the core.

The optoelectronic sensor is a line sensor detecting part of the outer circumference of the core of the rotating roll without additional illumination. There is also provided a controller used for generating a control signal if a height of the film material wound upon the core, which is sensed by the optoelectronic sensor, under-run a predetermined threshold.

The sensor arrangement may comprise a capacitive sensor in addition to the optoelectronic sensor. The capacitive sensor is arranged to be movable radially relative to the roll. The radial height with respect to the roll may be measured by means of the capacitive sensor. There is also provided a controller that allows generating a control signal if the radial height of the film material wound upon the core, which is sensed by the capacitive sensor, under-run a predetermined threshold.

The controller may be designed such that a combined and/or common control signal is only output if the height sensed by the optoelectronic sensor and the radial height sensed by the capacitive sensor under-run the predetermined threshold.

What is particularly advantageous is the use of the inventive sensor arrangement in a packaging machine for generating packs of articles. As already mentioned, two rolls having film material wound thereon are associated with a packaging machine. One of the two rolls is always the active roll. In order to prevent interruption of the pack production process for an unnecessarily long time, detection of the film end on the active roll is needed. When determining the end of the film material on the roll, it is important to use as much of the film material as possible. It is desirable to avoid too early changing of rolls, which would turn film material that could still be used for packaging packs into waste. When the film end and/or the approaching end of the film material on the roll is detected, a signal is output and there is a switch to the stock roll.

The optoelectronic sensor (line sensor) positioned stationary in the direction of the film roll on the front side is used to detect the outer edge (circumference) of the film core and the outer diameter of the film roll. A defined value to be programmed once specifies the minimum distance (threshold) of the diameter of the film roll triggering the output of a signal indicating the end of the film material on the roll. When the value under-runs this threshold, a signal is sent to the machine controller indicating that the film material on the active roll is running out. The invention has the advantage that a reliable detection of the end of the film material on the roll may be determined independent of the diameter of the core of the roll.

The inventive packaging machine is used for generating packs of articles and comprising a device for monitoring at least one roll of film material wound thereon upon a core of the roll. A sensor arrangement id provided for detecting an end of the film material on each of the at least one roll. At least one optoelectric sensor being part of the sensor arrangement, wherein the optoelectric sensor is arranged stationary relative to a front side of each of the at least one rotating roll resting on a mandrel. The optoelectric sensor is designed such that part of the front side of the rotating roll is optically detectable.

BRIEF DESCRIPTION OF THE DRAWINGS

The proportions of the individual elements in the drawings relative to each other do not always represent real proportions, because some elements have been simplified and some elements have been magnified as compared to others for better illustration. The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
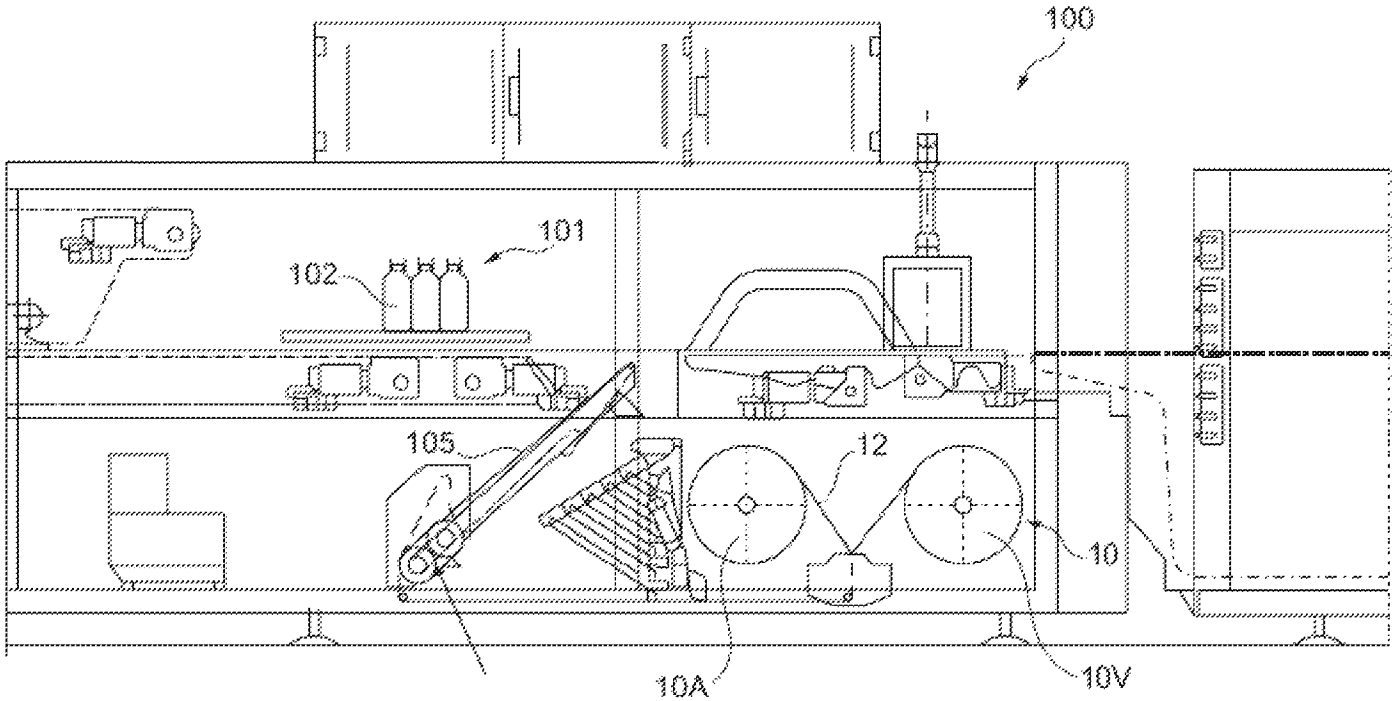
Fig. 1 Prior Art
FIG. 1 schematically shows a packaging machine.

Referring now to the figures, FIG. 1 shows a schematic view of packaging machine 100. Each group 101 of objects 102 is wrapped with a cut film portion 105. The cut film portions 105 are provided by at least one roll 10 of film material 12. In the embodiment shown in FIG. 1, two rolls 10 of film material 12 are provided. One roll 10 is the active roll 10A, which means that the film material 12 is pulled off this roll for wrapping the groups 101 of objects 102. The stock roll 10V is used when the film material 12 on the active roll 10A is running out. The switch from the active roll 10A to the stock roll 10V is intended to be as smooth as possible.

Figure 2:
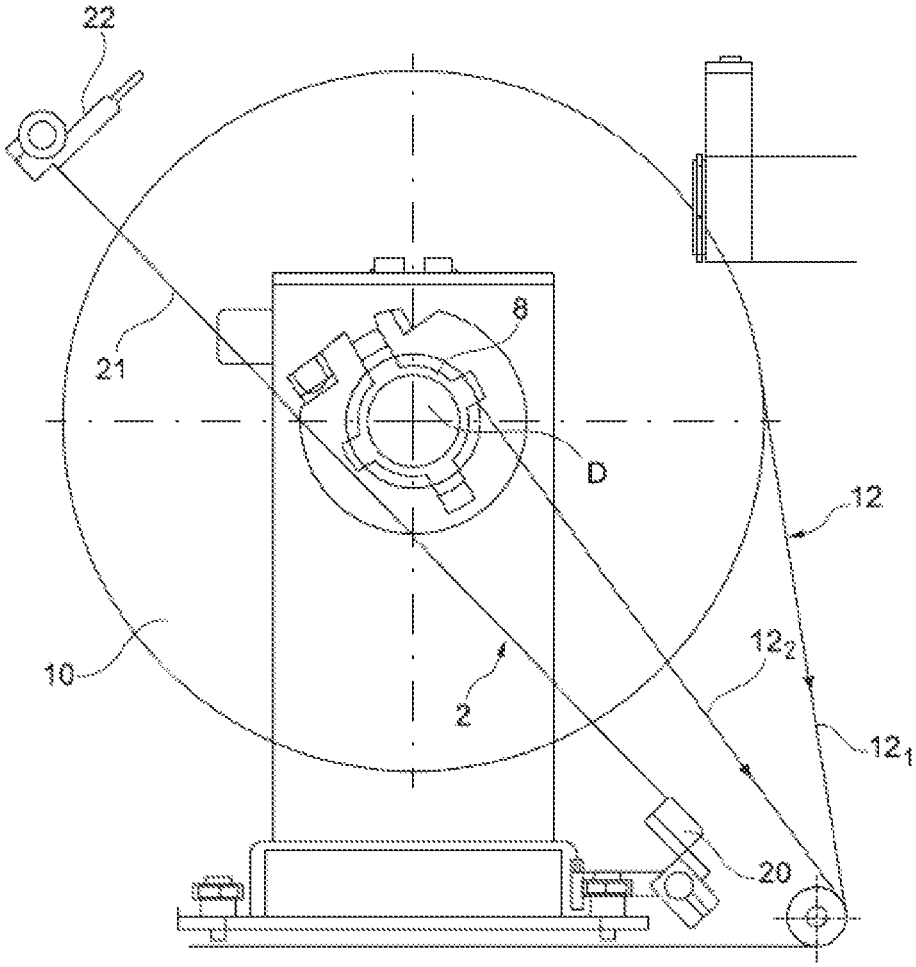
Fig. 2 Prior Art
FIG. 2 shows a device for determining the end of film material on a roll.

FIG. 2 shows sensor arrangement 2 that allows detecting an end of the film material 12 on the roll 10. The sensor arrangement 2 consists of a light source 20 implemented as a laser. The light source 20 emits a light beam 21 impinging on a detector 22. The light beam 21 only impinges on the detector 22 when a certain amount of film material 12 has been pulled off the roll 10. The film material 12 is wound upon a core 8. FIG. 2 shows a situation in which the film material 121 is pulled off a nearly full roll 10 of film material 12. In this situation, the light beam 21 is blocked by the film material 12 wound on the roll 10. When a certain amount of film material 12 has been unwound from the roll 10, as illustrated by the reference numeral 122, the light beam 21 is able to pass the circumference of the film material 12 still on the core 8 and reaches the detector 22. Now a signal may be output by the detector 22, which indicates the end of the film material 12 on the roll 10. This arrangement is disadvantageous in that, depending on the diameter D of the core 8, the end of the film material on the roll 10 fails to be reliably detected. For example, it may happen that, in the case of a large diameter D of the film core 8, the end of the film material 12 on the roll 10 is not detected at all. However, if the diameter D of the core 8 is small, the light beam 21 will already reach the detector 22 when there is still enough film material 10 wound upon the core 8 of the roll 10 that could still be used for wrapping articles. In this case, a lot of useful film material 12 will be unnecessarily thrown away.

Figure 3:
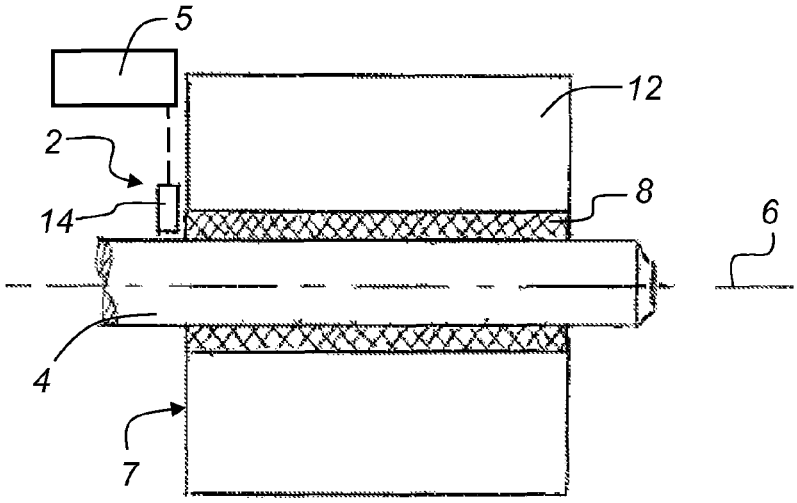
FIG. 3 shows a schematic side view of the film roll with the associated optoelectronic sensor.

FIG. 3 shows a schematic illustration of the sensor arrangement 2 associated with a roll 10 of film material 12. The film material 12 is wound upon a core 8 of a roll 10. The roll 10 rests on a mandrel 4 rotatable around an axis 6. In the embodiment shown in FIG. 3, the sensor arrangement 2 consists of an optoelectronic sensor 14. The optoelectronic sensor 14 is connected to a controller 5.

The line sensor 14 is arranged opposite to a front area 7 of the roll 10. The line sensor 14 has a detection area 15 (see FIG. 5), and the line sensor 14 is arranged stationary relative to the rotating roll 10. The arrangement of the line sensor 14 and its detection area 15 are designed such that both the core 8 of the roll 10 and at least part of the film material 12 wound upon the core 8 are located within the detection area 15 of the line sensor 14.

Figure 4:
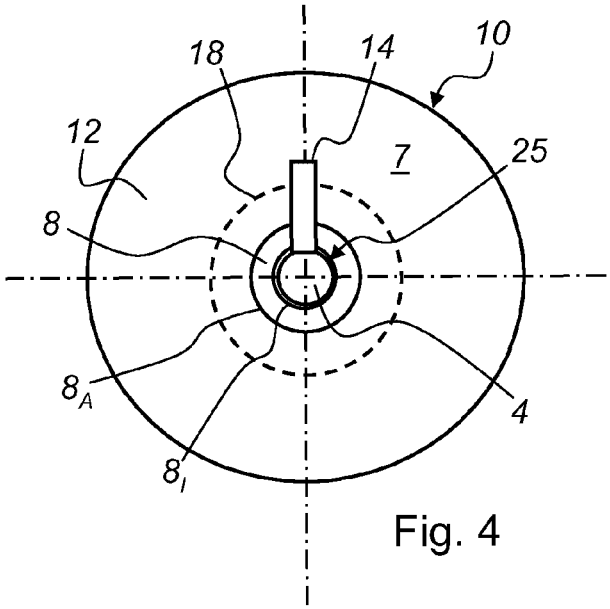
FIG. 4 shows a front view of the film roll with the associated optoelectronic sensor.

FIG. 4 shows a front view of the roll 10 with the film material 12 wound upon the core 8. It is apparent from FIG. 4 that, relative to the front side 7 of the roll 10, the optoelectronic sensor 14 (or line sensor) is arranged such that at least the core 8 and part of the film material 12 wound upon the core 8 are detected. In the embodiment shown in FIG. 4, the optoelectronic sensor 14 is designed such that a detection area 15 of the optoelectronic sensor 14 extends from the mandrel 4 of the roll 10 far beyond the core 8 of the roll 10. This arrangement allows detecting the decrease of film material 12 on the roll 10. The broken circle shown in FIG. 4 represents an outer circumference 18 of the film material 12 still present on the roll 10 at a certain processing point. The shown embodiment of the optoelectronic sensor 14 even allows detecting the decrease over time of the film material 12 on the roll 10. The optoelectronic sensor 14 also allows detecting a potential air gap 25 between the mandrel 4 and an inner circumference 8I of the core 8 of the roll 10. If the rest of the film material 12 remaining on the core 8 of the roll 10 has reached a predefined height H with respect to an outer circumference 8A of the core 8, this is sensed by the optoelectronic sensor 14, and a corresponding signal is output to the controller 5.

Figure 5:
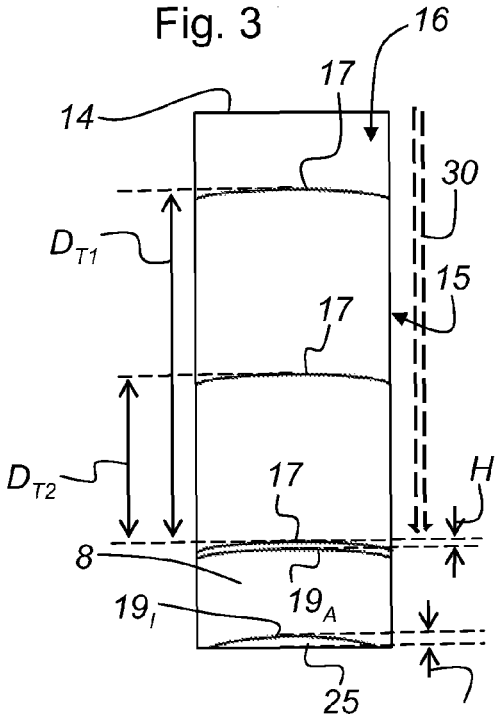
FIG. 5 shows a detail view of the area around the core of the roll that is sensed by the optoelectronic sensor.

FIG. 5 shows a detail 16 and/or the signal diagram of the detail 16 of the front side 7 of the rotating roll 10, which is detected by the optoelectronic sensor 14. Relative to the front side 7 of the roll 10, the optoelectronic sensor 14 is arranged such that at least both part of the core 8 and part of the film material 12 wound on the roll 10 are located within the detection area 15 of the optoelectronic sensor 14 (line sensor).

FIG. 5 shows the signal diagram of the detail 16 of the optoelectronic sensor 14 as arranged in FIG. 4. The optoelectronic sensor 14 detects a part 17 of the outer circumference 18 (see FIG. 4) of the amount of film material 12 on the roll 10, which changes over time. The change of a distance DT1, DT2 over time is indicated by the broken arrow 30 in FIG. 5. This arrangement of the optoelectronic sensor 14 also allows detecting a part 17 of the outer circumference 18 of the film material 12 wound upon the core 8. When the film material 12 wound upon the core 8 approaches the end, the predefined height H is determined from the part 17 of the outer circumference 18, which finally indicates the end of the film material 12 wound upon the core 8. The distance between the part 17 of the outer circumference 18 of the film material 12 reaches the predefined height H indicating the approaching end of the film material 12. Furthermore, there may also be detected a part 19A of the outer circumference 8A and a part 19I of the inner circumference 8I of the core 8. If an air gap 25 forms between the core 8 and the mandrel 4, this may also be detected by means of the optoelectronic sensor 14, because this embodiment of the arrangement of the optoelectronic sensor 14 allows detecting the air gap 25 between the core 8 and the mandrel 4. In addition to the changing of the distance DT1, DT2 of the outer circumference 18 of the film material 12 over time, the optoelectronic sensor 14 also has a safeguard function so that a potential malfunction may be indicated.

In addition to the outer circumference 18 of the decreasing film material 12, the outer circumference 8A of the core 8 and the inner circumference 8I of the core 8, the optoelectronic sensor 14 now also detects the air gap 25 between the core 8 and the mandrel 4. Thus the optoelectronic sensor 14 may also be programmed such that, in addition to the distance DT1, DT2 of the film material relative to the outer circumference 8A of the core 8, which decreases over time, the absolute diameter of core 8 and film material 12 on the roll 10 may also be sensed as safeguard function and adjusted accordingly by the controller 5.

Figure 6:
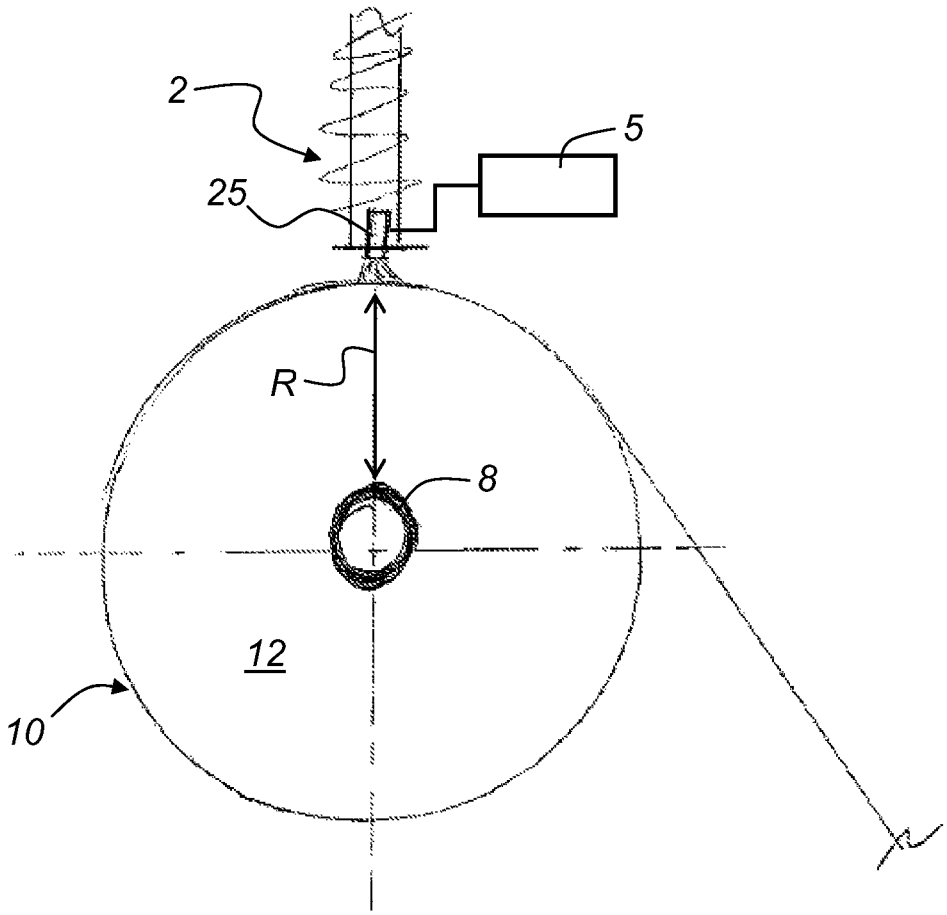
FIG. 6 shows a capacitive sensor movable in a radial direction relative to the film roll and which determines the end of the film material on the roll together with the optoelectronic sensor.

FIG. 6 shows a further embodiment for determining the amount of film material 12 present on the roll 10. The sensor arrangement 2 is implemented as capacitive sensor 25. The capacitive sensor 25 lightly rests on the film material 12 wound on the roll 10 or is at least arranged directly next to the film material 12. The capacitive sensor 25 is movable radially with respect to the core 8 of the roll 10. The capacitive sensor 25 allows detecting the radial height R of the film material 12 located on the core 8 of the roll 10. The capacitive sensor 25 moves closer to the core 8 depending on the film material 12 pulled off the roll 10. The capacitive sensor 25 also outputs a signal to the controller 5 when the capacitive sensor 25 senses a radial height R that is below a predetermined threshold.

The capacitive sensor 25 is used as additional means, besides the optoelectronic sensor 14 that determines the remaining height H of the film material on the core 8. If the capacitive sensor 25 and the optoelectronic sensor 14 provide a signal to the controller 5, it may be assumed that the end of the film material 12 on the core 8 has been reached and/or that a change of rolls is required in order to ensure continuing operation of the machine using the film material 12. The optoelectronic sensor 14 outputs a signal when the height H of the film material 12 on the core 8 under-runs a certain threshold. At the same time, the capacitive sensor 25 outputs a signal when the radial height R of the film material 12 on the core under-runs a predefined threshold. This additional safeguard achieved by the capacitive sensor 25 provides a more reliable determination of the end of the film material 12 on the roll 10.

For someone skilled in the art, it is obvious that the capacitive sensor 25 is an additional safeguard for the determination of the end of the film material 12 on the roll. However, the optoelectronic sensor 14 by itself is absolutely sufficient for determining the end of the film material 12 on the roll 10.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A device for monitoring a roll of film material wound thereon upon a core of the roll comprising:

a sensor arrangement for detecting an end of the film material on the roll; and at least one optoelectric sensor being part of the sensor arrangement, wherein the optoelectric sensor is arranged stationary relative to a front side of the rotating roll resting on a mandrel, and is designed such that part of the front side of the rotating roll is optically detectable;

wherein the optoelectronic sensor is a line sensor, detecting a part of an outer circumference of the core of the rotating roll without additional illumination; and, wherein a controller is provided that allows generating a control signal if a height between the outer circumference of the core and an outer circumference of the film material wound upon the core, which is sensed by the optoelectronic sensor, under-run a predetermined threshold.

2. The device of claim 1, wherein the optoelectronic sensor is programmable such that the outer circumference of the decreasing film material, the outer circumference of the core, the inner circumference of the core and/or the air gap between the core (8) and the mandrel are detectable.

3. The device of claim 1, wherein the optoelectronic sensor has a safeguard function and also detects a distance of the film material relative to the outer circumference of the core, which decreases over time, and the absolute diameter of core and film material on the roll.

4. The device of claim 1 wherein the optoelectronic sensor is arranged, relative to the roll, such that a portion of the front side of the rotating roll that is detected by the optoelectronic sensor includes a potential air gap between the mandrel and the core, the core itself and the film material directly adjacent to the core.

5. A packaging machine for generating packs of articles comprising:

a device for monitoring at least one roll of film material wound thereon upon a core of the roll;

a sensor arrangement for detecting an end of the film material on the at least one roll; and at least one optoelectric sensor being part of the sensor arrangement, wherein the optoelectric sensor is arranged stationary relative to a front side of each of the at least one rotating roll resting on a mandrel, and is designed such that part of the front side of the rotating roll is optically detectable;

wherein the optoelectronic sensor is a line sensor, detecting a part of an outer circumference of the core of the rotating roll without additional illumination; and, wherein a controller is provided that allows generating a control signal if a height between the outer circumference of the core and an outer circumference of the film material wound upon the core, which is sensed by the optoelectronic sensor, under-run a predetermined threshold.

6. The packaging machine of claim 5, wherein the optoelectronic sensor is programmable such that the outer circumference of the decreasing film material, the outer circumference of the core, the inner circumference of the core and/or the air gap between the core and the mandrel are detectable.

7. The packaging machine of claim 5, wherein the optoelectronic sensor has a safeguard function and also detects a distance of the film material relative to the outer circumference of the core, which decreases over time, and the absolute diameter of core and film material on the roll.

8. The packaging machine of claim 5, wherein the optoelectronic sensor is arranged, relative to the roll, such that a portion of the front side of the rotating roll that is detected by the optoelectronic sensor includes a potential air gap between the mandrel and the core, the core itself and the film material directly adjacent to the core.

9. The packaging machine of claim 5, wherein the sensor arrangement additionally includes a capacitive sensor arranged to be movable radially relative to the roll.

10. A device for monitoring a roll of film material wound thereon upon a core of the roll, comprising:

a sensor arrangement for detecting an end of the film material on the roll;

at least one optoelectric sensor being part of the sensor arrangement, wherein the optoelectric sensor is arranged stationary relative to a front side of the rotating roll resting on a mandrel, and is designed such that part of the front side of the rotating roll is optically detectable; and a capacitive sensor being part of the sensor arrangement, wherein the capacitive sensor is arranged that it is movable radially relative to the roll;

wherein a radial height of the film material present on the core of the roll is detectable by means of the capacitive sensor; and, wherein a controller is provided that allows generating a control signal if a height between an outer circumference of the core and an outer circumference of the film material wound upon the core, which is sensed by the optoelectronic sensor, under-run a predetermined threshold and wherein the controller allows generating a control signal if the radial height of the film material wound upon the core, which is sensed by the capacitive sensor, under-runs a predetermined threshold.

11. The device of claim 10, wherein the optoelectronic sensor is arranged, relative to the roll, such that the a portion of the front side of the rotating roll that is detected by the optoelectronic sensor includes a potential air gap between the mandrel and the core, the core itself and the film material directly adjacent to the core.

12. A device for monitoring a roll of film material wound thereon upon a core of the roll comprising:

a sensor arrangement for detecting an end of the film material on the roll; and at least one optoelectronic sensor being part of the sensor arrangement, wherein the optoelectronic sensor is arranged stationary relative to a front side of the rotating roll resting on a mandrel, and is designed such that part of the front side of the rotating roll is optically detectable;

wherein the sensor arrangement additionally includes a capacitive sensor arranged to be movable radially relative to the roll;

wherein a radial height of the film material present on the core of the roll is detectable by means of the capacitive sensor; and, wherein a controller is provided that allows generating a control signal if the radial height of the film material wound upon the core, which is sensed by the optoelectronic sensor and the capacitive sensor, under-runs a predetermined threshold.

13. The device of claim 12, wherein the controller is designed such that a common control signal may only be output if a height sensed by the optoelectronic sensor and the radial height sensed by the capacitive sensor pass below the predetermined threshold.

* * * * *